US007595777B2

(12) United States Patent
Kim et al.

(10) Patent No.: US 7,595,777 B2
(45) **Date of Patent: *Sep. 29, 2009**

(54) ORGANIC ELECTROLUMINESCENT MODULE

(75) Inventors: Hak Su Kim, Seoul (KR); Jong Geun Yoon, Anyang-si (KR); Sung Tae Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 712 days.

This patent is subject to a terminal disclaimer.

(21) Appl. No.: 11/261,634

(22) Filed: Oct. 31, 2005

(65) Prior Publication Data

US 2006/0055638 A1 Mar. 16, 2006

Related U.S. Application Data

(63) Continuation of application No. 10/434,473, filed on May 9, 2003, now Pat. No. 6,972,743.

(30) Foreign Application Priority Data

May 9, 2002 (KR) ..... 10-2002-25559

(51) Int. Cl.
*G09G 3/30* (2006.01)

(52) U.S. Cl. ..... 345/76; 345/36

(58) Field of Classification Search ..... 345/87–100, 345/204, 36–55, 63, 76–78, 101, 102; 315/169.1, 315/169.2, 169.3
See application file for complete search history.

(56) References Cited

U.S. PATENT DOCUMENTS 5,306,967 A 4/1994 Dow ..... 326/101
5,517,207 A 5/1996 Kawada et al. ..... 345/78
5,703,501 A 12/1997 Geisler ..... 326/96
5,856,813 A 1/1999 Katayama et al. ..... 345/76
5,923,309 A 7/1999 Ishizuka et al. ..... 345/82
5,973,456 A 10/1999 Osada et al. ..... 315/169.1
6,262,593 B1 7/2001 Sobelman et al. ..... 326/35
6,288,593 B1 9/2001 Tran et al. ..... 327/408

(Continued)

FOREIGN PATENT DOCUMENTS

JP 04-014794 A 1/1992
JP 04-245294 1/1992
JP 06-013181 A 1/1994
JP 11-162637 A 6/1999
JP 2001-092411 A 4/2001
JP 2001-331149 A 11/2001

OTHER PUBLICATIONS

European Office Action dated Dec. 15, 2006.
Japanese Office Action dated Mar. 24, 2009.
European Search Report dated Nov. 29, 2005.

*Primary Examiner*—Nitin Patel
(74) *Attorney, Agent, or Firm*—Ked & Associates, LLP

(57) ABSTRACT

An organic electroluminescent module is disclosed. The organic electroluminescent module comprises a plurality of scan lines, a plurality of data lines perpendicular to the plurality of scan lines, a plurality of light emitting diodes formed at cross regions of the plurality of scan lines and the plurality of data lines, a scan driver having inverse voltage applying transistors and ground voltage applying transistors respectively connected to the plurality of scan lines, a data driver having static current sources and ground voltage applying transistors respectively connected to the plurality of data lines, and a driver controller for controlling the scan driver and the data driver. Impurities in the organic EL module can easily be eliminated by an inverse voltage. As a result, a lifetime of the organic EL module can be prolonged and quality of display can be improved.

15 Claims, 2 Drawing Sheets

U.S. PATENT DOCUMENTS 6,337,542 B1 1/2002 Hanaki et al. ..... 315/169.3
6,369,515 B1 4/2002 Okuda ..... 315/169.3
6,621,228 B2 9/2003 Harada et al. ..... 315/169.3
6,972,743 B2 * 12/2005 Kim et al. ..... 345/76
2004/0007987 A1 * 1/2004 Kim et al. ..... 315/169.2
2006/0055638 A1 * 3/2006 Kim et al. ..... 345/76

* cited by examiner

ORGANIC ELECTROLUMINESCENT MODULE

This application is a Continuation Application of U.S. patent application Ser. No. 10/434,473 filed on May 9, 2003, now U.S. Pat. No. 6,972,743, which claims the benefit of the Korean Application No. P2002-25559 filed on May 9, 2002, whose entire disclosures are incorporated herein by reference.

BACKGROUND

1. Field

The present disclosure relates to an organic electroluminescent (EL) module, in which aging can be carried out in a state that the fabrication of an organic EL module is finished.

2. Background of the Related Art

Recently, the EL device is favored as a prospective self-luminescent type flat display. Of the EL devices, different from an inorganic EL device, the organic EL device requires no AC or a high voltage. Moreover, it is comparatively easy for the organic EL device to provide a variety of colors, as there are a variety of organic compounds.

Recently, researches on application of the organic EL displays to full color displays and the like are active. Particularly, a structure which has a high luminance even at a low voltage is under development.

The inorganic EL device has a field excited type light emission. Different from this, the organic EL device has a so-called carrier injection type light emission, in which a light is emitted as a hole is injected from an anode and an electron is injected from a cathode. A positive carrier and a negative carrier injected from the two electrodes move to opposite electrodes, and when they couple, an exciton is formed. A light emitted when the exciton is moderated is a light the organic EL device.

The problem of defects is very important in the organic EL device. Particularly, the problem of short circuit occurred at the anode and the cathode due to impurities, such as particles from a substrate, is very important, along with a substrate cleaning problem.

In order to eliminate such substrate problems in advance, though the substrates are subjected to aging or burning in manufacturing, the particles cannot be removed fully.

As another method for solving the problem, the short circuit is removed by aging in a state an organic EL panel is fabricated. However, short circuit occurred as time goes by caused by particles is still a cause of defective modules.

Thus, there have been requirements for aging in a modular state for solving the problem.

SUMMARY

The present application discloses an organic EL module including a plurality of scan lines and data lines comprising: a scan driver having inverse voltage applying transistors respectively connected to the plurality of scan lines, a data driver having ground voltage applying transistors respectively connected to the plurality of data lines, and a driver controller controlling the scan driver and the data driver so that an inverse voltage is applied to a relevant scan line and a ground voltage is applied to a relevant data line at the same time.

The present application discloses an organic EL module including a plurality of scan lines and data lines comprising: a scan driver having inverse voltage applying transistors and ground voltage applying transistors respectively connected to the plurality of scan lines, a data driver having static current sources and ground voltage applying transistors respectively connected to the plurality of data lines, and a driver controller controlling the scan driver and the data driver, wherein the scan driver applies a ground voltage to the scan lines to be driven and applies a reverse voltage to the scan lines not to be driven, and at the same time with this, the data driver applies a data signal to the data lines to be driven and applies a ground voltage to the data line not to be driven.

The present application discloses an organic EL module including a plurality of scan lines and data lines comprising: a scan driver having inverse voltage applying transistors and ground voltage applying transistors respectively connected to the plurality of scan lines, a data driver having static current sources and ground voltage applying transistors respectively connected to the plurality of data lines, and a driver controller controlling the scan driver and the data driver, wherein the driver controller turns on at least one ground voltage applying transistors in the data driver for grounding a relevant data line and at the same time with this, the driver controller turns on at least one of the inverse voltage applying transistors in the scan driver for applying an inverse voltage to a relevant scan lines.

It is to be understood that both the foregoing general description and the following detailed description are exemplary and explanatory and are intended to provide further explanation of the embodiment as claimed.

BRIEF DESCRIPTION OF THE DRAWINGS

The accompanying drawings, which are included to provide a further understanding of the disclosure and are incorporated in and constitute a part of this specification, illustrate embodiments of the invention and together with the description serve to explain the principles of the invention.

In the drawings.

DETAILED DESCRIPTION

Figure 1:
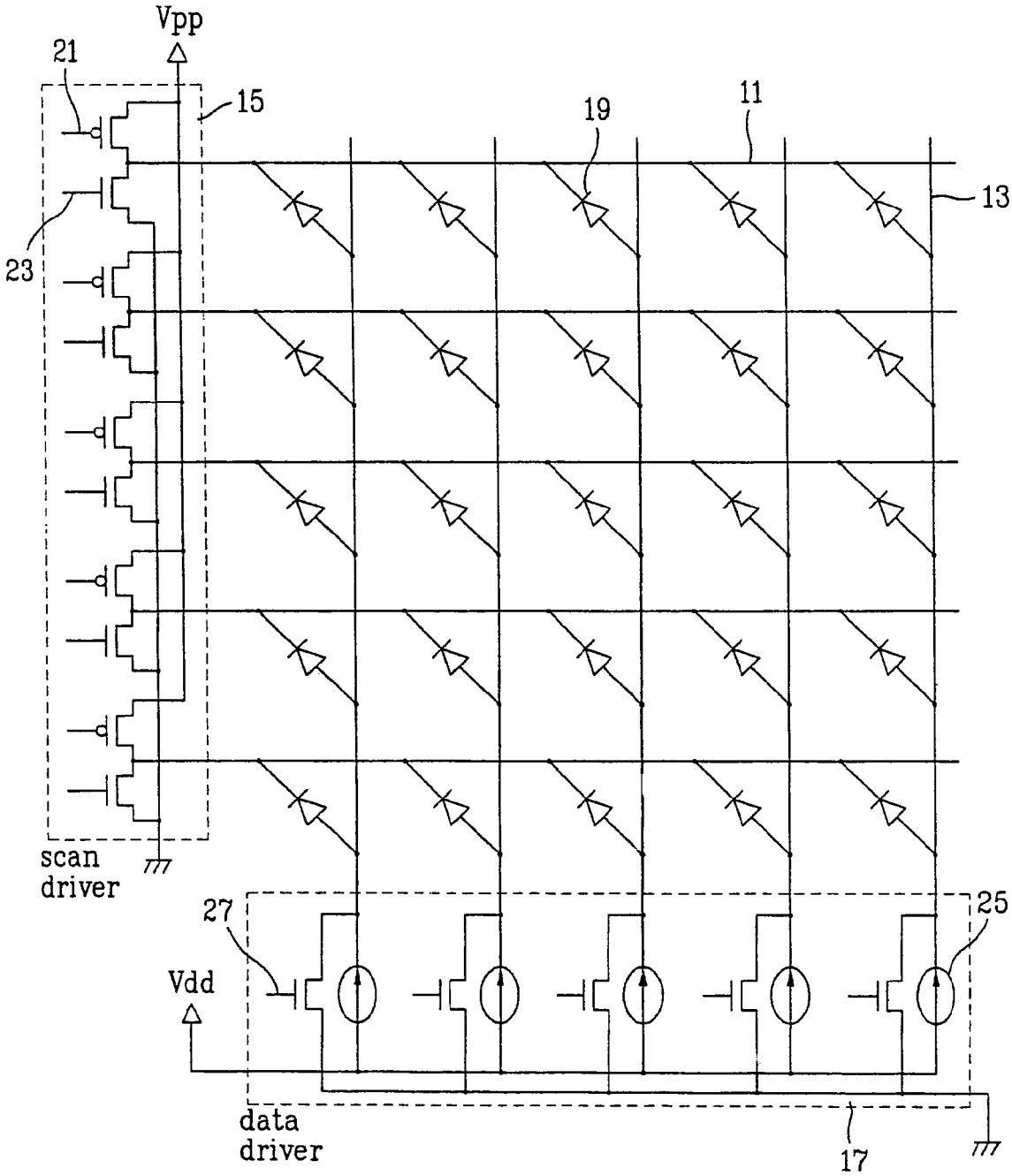
FIG. 1 illustrates a circuit of an organic EL module in accordance with an embodiment, schematically.

Reference will now be made in detail to the embodiments, examples of which are illustrated in the accompanying drawings. FIG. 1 illustrates a circuit of an organic EL module in accordance with an embodiment, schematically.

Referring to FIG. 1, the organic EL module includes a plurality of scan lines 11, a plurality of data lines 13, a plurality of light emitting diodes 19, a scan driver 15, and a data driver 17. Though not shown, the organic EL module further includes a driver controller for controlling the scan driver 15 and the data driver 17.

The light emitting diodes 19 are formed at every cross of the plurality of scan lines 11 and the plurality of data lines 13.

The scan driver 15 includes inverse voltage applying transistors 21 and ground voltage applying transistors 23 respectively connected to the plurality of scan lines 11. The data driver 17 includes ground voltage applying transistors 27 and static current sources 25 respectively connected to the plurality of data lines 13.

The scan driver 15 and the data driver 17 are connected to power sources Vpp and Vdd for providing signals to the scan lines 11 and the data lines 13.

Particularly, the driver controller turns on at least one of the inverse voltage applying transistors 21 in the scan driver 15 for applying a high inverse voltage lower than a breakdown voltage from the power source Vpp to a relevant scan line 11.

At the same time with this, the driver controller turns on at least one ground voltage applying transistors 27 in the data driver 17 for grounding a relevant data line 13. As a result of this, the light emitting diode 19 can have a high inverse voltage applied thereto.

Thus, the organic EL module includes a scan driver 15 having inverse voltage applying transistors 21 and ground voltage applying transistors 23 connected to a plurality of scan lines 11, and a data driver having ground voltage applying transistors 27 and static current sources 25 connected to a plurality of data lines 13.

The foregoing organic EL module displays a picture as follows.

In regular operation, for a fixed time period for every frame, the scan driver 15 turns on the ground voltage applying transistors 23 and applies a ground voltage to scan lines 11 to be driven, and turns on inverse voltage applying transistors 21 and applies an inverse voltage Vpp to the scan lines 11 not to be driven.

At the same time with this, for the fixed time period for every frame, the data driver 17 applies a data signal to the data line 13 to be driven through the static current source 25, and applies a ground voltage to the data lines 13 not to be driven by turning on the ground voltage applying transistors 23.

Consequently, the organic EL module can form a picture by using a voltage difference applied to parts the plurality of scan lines 11 and the data lines 13 crosses.

However, in a case there is a defect caused by impurities, such as particles, in an inside of the organic EL panel (that is, the scan line 11 and the data line 13 are short circuited), a line form of defective picture can be formed along the scan line 11 or the data line 13. For prevention of such a defect, it is necessary to subject the organic EL module to aging.

Figure 2:
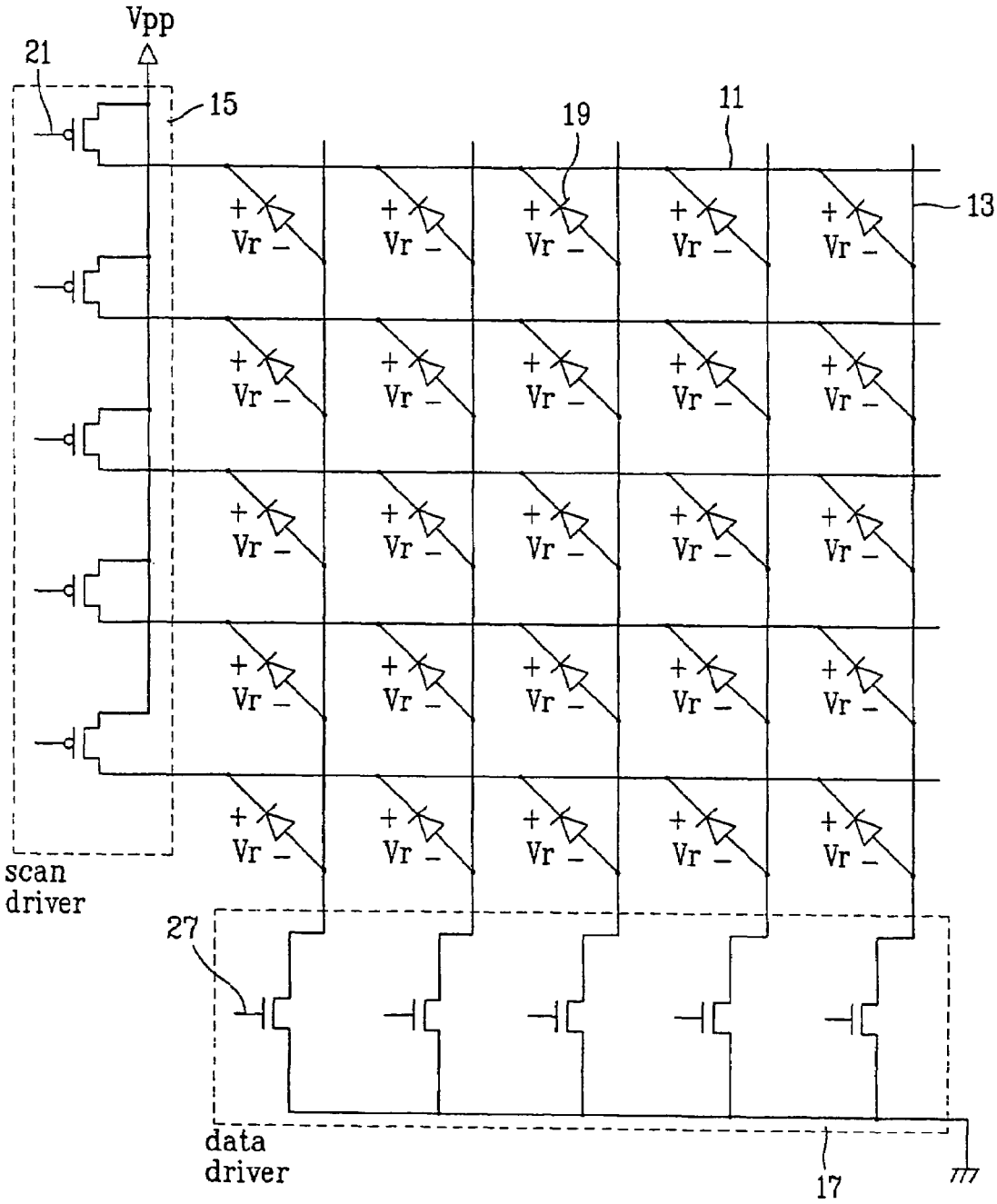
FIG. 2 illustrates an aging circuit of an organic EL module in accordance with an embodiment.

The embodiment disclosed prevents a poor picture quality caused by impurities and prolongs a lifetime of an organic EL module by providing a method for aging the organic EL module or the organic EL module mounted on a mobile device, directly. FIG. 2 illustrates an aging circuit of an organic EL module in accordance with an embodiment.

Referring to FIG. 2, in the method for aging an organic EL module, a ground voltage is applied to the data lines 13 connected to the data driver 17, and an inverse voltage Vpp is applied to the scan lines connected to the scan driver 15.

In this instance, as described before, the driver controller the driver controller turns on at least one of the inverse voltage applying transistors 21 in the scan driver 15 for applying a high inverse voltage lower than a breakdown voltage from the power source Vpp to a relevant scan line 11. At the same time with this, the driver controller turns on at least one ground voltage applying transistors 27 in the data driver 17 for grounding a relevant data line 13. As a result of this, the light emitting diode 19 has a high inverse voltage applied thereto. The inverse voltage burns particles between the data lines 13 and the scan lines 11 so as to remove electrical connection between the lines at a voltage below a breakdown voltage.

In comparison of output voltages of the data driver 17 and the scan driver 15, the output voltage of the data driver 17 may be set to a low or a ground voltage, and the output voltage of the scan driver 15 may be set to a high or a voltage higher than a predetermined voltage.

Or, the organic EL module can have an inverse voltage applied thereto by controlling operation of the data driver 17 and the scan driver 15 according a fixed waveform preset at the driver controller.

The turn on/off operation of the ground voltage applying transistors 27 and the inverse voltage applying transistors 21 in the data driver 17 and the scan driver 15 may be carried out according to a state of a pin preset at the driver controller.

It is preferable that the output voltage of the scan driver 15 is limited below to a preset voltage of a level enough to remove the particles present in the organic EL module.

Moreover, the method for aging an organic EL module may be designed to apply the inverse voltage to the data driver 17 and the scan driver 15 on hardware basis or software basis for removing the impurity, such as particles.

Furthermore, the organic EL module may be mounted on a mobile device, so that a user subjects the organic EL module to aging by directly selecting an aging menu or a key on the mobile device.

As described, the organic EL module applies a ground voltage to the data lines 13 and a high inverse voltage to the scan lines 11 in a state fabrication of the organic EL module is finished. As a result, an electrical connection between the data line 13 and the scan line 11 occurred by particles can be removed, to prolong a lifetime of the organic EL module and improve a picture quality.

It will be apparent to those skilled in the art that various modifications and variations can be made in the present invention without departing from the spirit or scope of the disclosure. Thus, it is intended that the present disclosure cover the modifications and variations of this disclosure provided they come within the scope of the appended claims and their equivalents.

What is claimed is:

1. An organic EL module including a plurality of scan lines and data lines comprising:

a scan driver having inverse voltage applying transistors respectively connected to the plurality of scan lines;

a data driver having ground voltage applying transistors respectively connected to the plurality of data lines; and a driver controller controlling the scan driver and the data driver so that an inverse voltage is applied to a relevant scan line and a ground voltage is applied to a relevant data line at the same time.

2. The organic EL module as claimed in claim 1, the inverse voltage applying transistor and the ground voltage applying transistor turn on periodically according to a predetermined waveform.

3. The organic EL module as claimed in claim 2, the waveform is a pulse or sinusoidal wave.

4. The organic EL module as claimed in claim 1, the inverse voltage applying transistor and the ground voltage applying transistor are operated according to a state of a pin preset at the driver controller.

5. The organic EL module as claimed in claim 1, the inverse voltage applying transistor applies an extent of current that eliminates electrical abnormalities caused by impurities of an organic electroluminescent panel.

6. The organic EL module as claimed in claim 1, an output voltage of the scan driver is set to a high, and an output voltage of the data driver is set to a low.

7. The organic EL module as claimed in claim 1, the driver controller controls the scan driver and the data driver according to a fixed waveform preset.

8. An organic EL module including a plurality of scan lines and data lines comprising:

a scan driver having inverse voltage applying transistors and ground voltage applying transistors respectively connected to the plurality of scan lines;

a data driver having static current sources and ground voltage applying transistors respectively connected to the plurality of data lines; and a driver controller controlling the scan driver and the data driver, wherein the scan driver applies a ground voltage to the scan lines to be driven and applies a reverse voltage to the scan lines not to be driven, and at the same time with this, the data driver applies a data signal to the data lines to be driven and applies a ground voltage to the data line not to be driven.

9. The organic EL module as claimed in claim 8, the inverse voltage applying transistor and the ground voltage applying transistor turn on periodically according to a predetermined waveform.

10. The organic EL module as claimed in claim 9, the waveform is a pulse or sinusoidal wave.

11. The organic EL module as claimed in claim 8, the inverse voltage applying transistor and the ground voltage applying transistor are operated according to a state of a pin preset at the driver controller.

12. The organic EL module as claimed in claim 8, the inverse voltage applying transistor applies an extent of current that eliminates electrical abnormalities caused by impurities of an organic electroluminescent panel.

13. The organic EL module as claimed in claim 8, an output voltage of the scan driver is set to a high, and an output voltage of the data driver is set to a low.

14. The organic EL module as claimed in claim 8, the driver controller controls the scan driver and the data driver according to a fixed waveform preset.

15. An organic EL module including a plurality of scan lines and data lines comprising:

a scan driver having inverse voltage applying transistors and ground voltage applying transistors respectively connected to the plurality of scan lines;

a data driver having static current sources and ground voltage applying transistors respectively connected to the plurality of data lines; and a driver controller controlling the scan driver and the data driver, wherein the driver controller turns on at least one ground voltage applying transistors in the data driver for grounding a relevant data line and at the same time with this, the driver controller turns on at least one of the inverse voltage applying transistors in the scan driver for applying an inverse voltage to a relevant scan lines.

* * * * *